US009149412B2

(12) United States Patent
Faller et al.

(10) Patent No.: US 9,149,412 B2
(45) Date of Patent: Oct. 6, 2015

(54) HUMAN POWERED MECHANICAL CPR DEVICE WITH OPTIMIZED WAVEFORM CHARACTERISTICS

(75) Inventors: Frederick W. Faller, Chelmsford, MA (US); Gary A. Freeman, Chelmsford, MA (US)

(73) Assignee: ZOLL Medical Corporation, Chelmsford, MA (US)

( * ) Notice: Subject to any disclaimer, the term of this patent is extended or adjusted under 35 U.S.C. 154(b) by 207 days.

(21) Appl. No.: 13/523,561

(22) Filed: Jun. 14, 2012

(65) Prior Publication Data

US 2013/0338550 A1 Dec. 19, 2013

(51) Int. Cl.
*A61H 31/00* (2006.01)
*A61H 11/00* (2006.01)

(52) U.S. Cl.
CPC ..... *A61H 31/006* (2013.01); *A61H 31/007* (2013.01); *A61H 2011/005* (2013.01); *A61H 2201/1215* (2013.01); *A61H 2201/1253* (2013.01); *A61H 2201/149* (2013.01); *A61H 2201/1418* (2013.01); *A61H 2201/1664* (2013.01); *A61H 2203/0456* (2013.01)

(58) Field of Classification Search
CPC ... A61H 31/00; A61H 31/006; A61H 31/007; A61H 31/008; A61H 2031/00; A61H 2031/003; A61H 2201/1215; A61H 2201/1253; A61H 2201/1418; A61H 2201/1664; A61H 2201/149
USPC ..... 601/41, 97
See application file for complete search history.

(56) References Cited

U.S. PATENT DOCUMENTS

| | | | | |
|---|---|---|---|---|
| 443,204 | A | | 12/1890 | Davis |
| 651,962 | A | | 6/1900 | Boghean |
| 2,070,215 | A | | 2/1937 | Nardone |
| 2,071,215 | A | | 2/1937 | Petersen |
| 2,486,667 | A | | 11/1949 | Meister |
| 2,699,163 | A | | 1/1955 | Engström |
| 2,754,817 | A | | 7/1956 | Nemeth |
| 2,780,222 | A | | 2/1957 | Polzin et al. |
| 2,853,998 | A | | 9/1958 | Emerson |
| 2,899,955 | A | | 8/1959 | Huxley, III et al. |
| 3,042,024 | A | | 7/1962 | Mendelson |
| 3,095,873 | A | | 7/1963 | Edmunds |
| 3,120,228 | A | | 2/1964 | Huxley, III |
| 3,368,550 | A | | 2/1968 | Glascock |
| 3,374,783 | A | | 3/1968 | Hurvitz |
| 3,461,860 | A | | 8/1969 | Barkalow et al. |
| 3,481,327 | A | | 12/1969 | Drennen |
| 3,489,140 | A | * | 1/1970 | Mullikin ..... 601/97 |
| 3,782,371 | A | | 1/1974 | Derouineau |

(Continued)

FOREIGN PATENT DOCUMENTS

| | | |
|---|---|---|
| JP | 4156823 | 5/1992 |
| JP | 8052217 | 2/1996 |

(Continued)

*Primary Examiner* — Justine Yu
*Assistant Examiner* — Timothy Stanis
(74) *Attorney, Agent, or Firm* — K. David Crockett, Esq.; Paul J. Backofen, Esq.; Crockett & Crockett, PC

(57) ABSTRACT

A CPR compression device driven by a cam, in which the cam is shaped to provide a desired compression waveform. The cam controls movement of a compression pad, and has angular regions shaped to provide a compression stroke, a high compression hold, and a release phase of the chest contacting means.

7 Claims, 8 Drawing Sheets

(56) References Cited

U.S. PATENT DOCUMENTS

| | | | |
|---|---|---|---|
| 3,802,638 | A | 4/1974 | Dragan |
| 3,822,840 | A | 7/1974 | Stephenson |
| 3,902,480 | A | 9/1975 | Wilson |
| 4,004,579 | A | 1/1977 | Dedo |
| 4,102,332 | A | 7/1978 | Gessman |
| 4,155,537 | A | 5/1979 | Bronson et al. |
| 4,365,623 | A | 12/1982 | Wilhelm et al. |
| 4,397,306 | A | 8/1983 | Weisfeldt et al. |
| 4,471,898 | A | 9/1984 | Parker |
| 4,570,615 | A | 2/1986 | Barkalow |
| 4,664,098 | A | 5/1987 | Woudenberg et al. |
| 4,702,231 | A | 10/1987 | Arpin |
| 4,770,164 | A | 9/1988 | Lach et al. |
| 4,829,285 | A | 5/1989 | Brand et al. |
| 4,915,095 | A | 4/1990 | Chun |
| 4,928,674 | A | 5/1990 | Halperin et al. |
| 5,056,505 | A | 10/1991 | Warwick et al. |
| 5,062,358 | A | 11/1991 | Fox |
| 5,098,369 | A | 3/1992 | Heilman et al. |
| 5,184,606 | A | 2/1993 | Csorba |
| 5,217,010 | A | 6/1993 | Tsitlik et al. |
| 5,222,478 | A | 6/1993 | Scarberry et al. |
| 5,228,449 | A | 7/1993 | Christ et al. |
| 5,257,619 | A | 11/1993 | Everete |
| 5,277,194 | A | 1/1994 | Hosterman et al. |
| 5,287,846 | A | 2/1994 | Capjon et al. |
| 5,295,481 | A | 3/1994 | Geeham |
| 5,327,887 | A | 7/1994 | Nowakowski |
| 5,359,999 | A | 11/1994 | Kinsman |
| 5,370,603 | A | 12/1994 | Newman |
| 5,383,840 | A | 1/1995 | Heilman et al. |
| 5,399,148 | A | 3/1995 | Waide et al. |
| 5,405,362 | A | 4/1995 | Kramer et al. |
| 5,407,418 | A | 4/1995 | Szpur |
| 5,411,518 | A | 5/1995 | Goldstein et al. |
| 5,416,826 | A | 5/1995 | Butler |
| 5,451,202 | A | 9/1995 | Miller et al. |
| 5,474,533 | A | 12/1995 | Ward et al. |
| 5,490,820 | A | 2/1996 | Schock et al. |
| 5,524,843 | A | 6/1996 | McCauley |
| 5,554,975 | A | 9/1996 | Hall et al. |
| 5,593,426 | A | 1/1997 | Morgan et al. |
| 5,620,001 | A | 4/1997 | Byrd et al. |
| 5,630,789 | A | 5/1997 | Schock et al. |
| 5,634,886 | A * | 6/1997 | Bennett ..... 601/41 |
| 5,644,294 | A | 7/1997 | Ness |
| 5,644,563 | A | 7/1997 | Yang |
| 5,664,563 | A | 9/1997 | Schroeder et al. |
| 5,673,304 | A | 9/1997 | Connor et al. |
| 5,694,452 | A | 12/1997 | Bertolet |
| 5,738,637 | A | 4/1998 | Kelly et al. |
| 5,792,190 | A | 8/1998 | Olson et al. |
| 5,833,711 | A | 11/1998 | Schneider |
| 5,866,711 | A | 2/1999 | Hung et al. |
| 6,090,056 | A | 7/2000 | Bystrom et al. |
| 6,179,793 | B1 | 1/2001 | Rothman et al. |
| 6,398,744 | B2 | 6/2002 | Bystrom et al. |
| 6,599,258 | B1 | 7/2003 | Bystrom et al. |
| 6,926,682 | B2 | 8/2005 | Bystrom et al. |
| 7,517,326 | B2 | 4/2009 | Mollenauer et al. |
| 2004/0030272 | A1 | 2/2004 | Kelly et al. |
| 2004/0220501 | A1 | 11/2004 | Kelly et al. |
| 2004/0225238 | A1 | 11/2004 | Sherman et al. |

FOREIGN PATENT DOCUMENTS

| | | |
|---|---|---|
| JP | 9095840 | 4/1997 |
| JP | 9183072 | 7/1997 |
| WO | WO9426229 | 11/1994 |
| WO | WO9722327 | 6/1997 |

* cited by examiner

HUMAN POWERED MECHANICAL CPR DEVICE WITH OPTIMIZED WAVEFORM CHARACTERISTICS

FIELD OF THE INVENTIONS

The inventions described below relate the field of CPR compression devices.

BACKGROUND OF THE INVENTIONS

Cardiopulmonary resuscitation (CPR) is a well-known and valuable method of first aid used to resuscitate people who have suffered from cardiac arrest. CPR requires repetitive chest compressions to squeeze the heart and the thoracic cavity to pump blood through the body. Artificial respiration, such as mouth-to-mouth breathing or a bag mask apparatus, is used to supply air to the lungs. When a first aid provider performs manual chest compression effectively, blood flow in the body is about 25% to 30% of normal blood flow. However, even experienced paramedics cannot maintain adequate chest compressions for more than a few minutes. Hightower, et al., *Decay In Quality Of Chest Compressions Over Time,* 26 Ann. Emerg. Med. 300 (September 1995). Thus, CPR is not often successful at sustaining or reviving the patient. Nevertheless, if chest compressions could be adequately maintained, then cardiac arrest victims could be sustained for extended periods of time. Occasional reports of extended CPR efforts (45 to 90 minutes) have been reported, with the victims eventually being saved by coronary bypass surgery. See Tovar, et al., *Successful Myocardial Revascularization and Neurologic Recovery,* 22 Texas Heart J. 271 (1995).

Numerous studies establish that good quality chest compressions are difficult to accomplish from a psycho-motor skill level on the part of the rescuer as and also require up to 150 pounds of force to compress the sternum to a depth sufficient to accomplish adequate blood flow. As a result, rescuers frequently fatigue during CPR to the point that they cannot deliver adequate compressions.

In efforts to provide better blood flow and increase the effectiveness of bystander resuscitation efforts, various pneumatic or electrically powered mechanical devices (machine-powered devices) have been proposed for performing CPR. In one variation of these devices, a pneumatically driven piston is suspended over the patient using a rigid gantry, as in the LUCAS® CPR device, or suspended over the patient with a cantilevered gantry arrangement, as in the THUMPER® CPR device. The LUCAS® II device uses a motor driven piston. In these devices, the piston is forced repeatedly downward to push on the patient's chest and thereby compress the chest. In another variation of such devices, a belt is placed around the patient's chest and the belt is used to effect chest compressions. Our own patents, Mollenauer, et al., Resuscitation Device Having A Motor Driven Belt To Constrict/Compress The Chest, U.S. Pat. No. 6,142,962 (Nov. 7, 2000); Sherman, et al., CPR Assist Device with Pressure Bladder Feedback, U.S. Pat. No. 6,616,620 (Sep. 9, 2003); Sherman et al., Modular CPR assist device, U.S. Pat. No. 6,066,106 (May 23, 2000); and Sherman et al., Modular CPR assist device, U.S. Pat. No. 6,398,745 (Jun. 4, 2002), show chest compression devices that compress a patient's chest with a belt. Each of these patents is hereby incorporated by reference in their entirety. Our commercial device, sold under the trademark AUTOPULSE®, is described in some detail in our prior patents, including Jensen, Lightweight Electro-Mechanical Chest Compression Device, U.S. Pat. No. 7,347,832 (Mar. 25, 2008) and Quintana, et al., Methods and Devices for Attaching a Belt Cartridge to a Chest Compression Device, U.S. Pat. No. 7,354,407 (Apr. 8, 2008). U.S. Pat. No. 6,616,620 also described a system for controlling the compression wave-form of the device. The compression wave-form refers to the graph of FIG. 1, which plots the compression depth versus time for a chest compression. The graph illustrates the down-stroke phase of the compression stroke, during which the sternum is depressed from a relaxed state to a compressed state, a hold phase, during which the patient's sternum is held at a particular distance from the spine, a release phase during which the sternum is allow to recoil to its natural uncompressed condition, and an inter-compression phase during which the sternum is substantially released or held at some minimal threshold of compression.

Human powered CPR devices have been proposed, such as those described in Kelly, et al., Chest Compression Apparatus for Cardiac Arrest, U.S. Pat. No. 5,738,637 (Apr. 14, 1998). These human-powered devices typically use some form of mechanical advantage to minimize the amount of force required to compress the sternum and thus reduce rescuer fatigue. A weakness of these human powered systems is that they still rely on psychomotor skill set of the rescuer to deliver compressions with the proper waveform characteristics that result in optimal blood flow.

SUMMARY

The devices and methods described below provide for simple mechanical control of a compression waveform. The desired waveform is one in which the hold phase duration is maximized while the release phase is minimized.

DETAILED DESCRIPTION OF THE INVENTIONS

Figure 2:
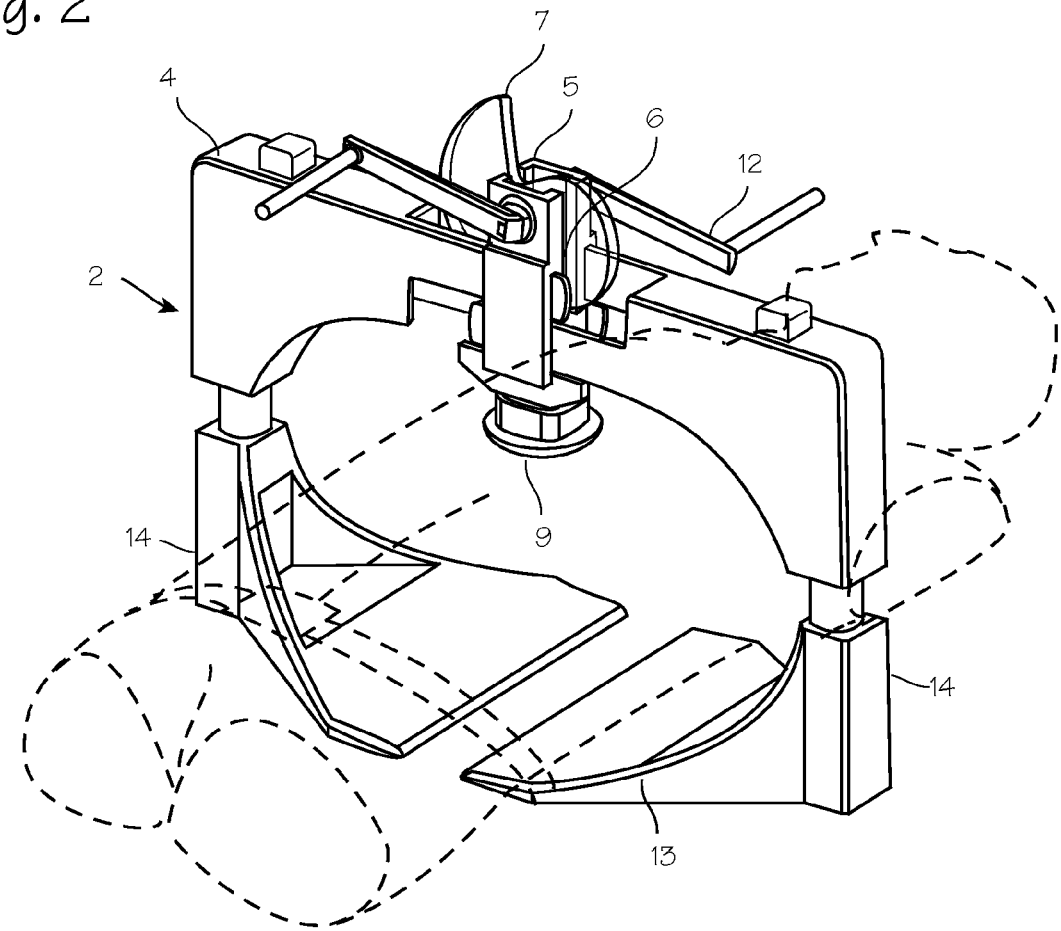
FIG. 2 illustrates the CPR compression device with the cam operated compressing piston, fitted on a patient.
Figure 3:
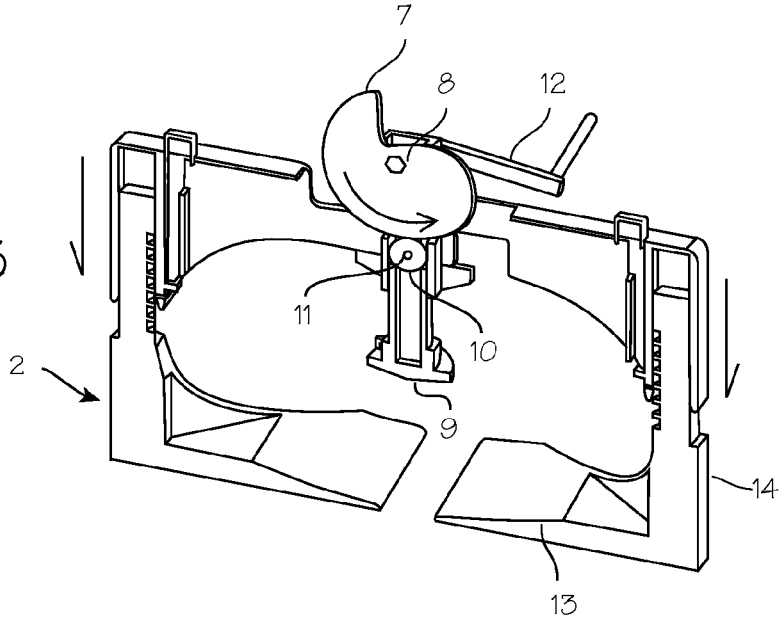
FIG. 3 is a cut away view of the CPR compression device of FIG. 2.

The human-powered mechanical chest compression device with compression waveform control is achieved by a cam-driven plunger arrangement powered by a rotating hand-crank as shown in FIGS. 2 and 3. FIGS. 2 and 3 illustrate the chest compression device, fitted on a patient 1. This chest compression device 2 applies compressions with the piston 3, which is suspended over the patient, either resting on the patient's chest and secured with straps, suspended over the patient using a rigid gantry (as is the LUCAS® CPR device), or suspended over the patient with a cantilevered gantry arrangement, as is the THUMPER® CPR device. As illustrated, the device comprises a rigid gantry 4 which suspends a piston housing 5, a follower piston 3 (shown in FIG. 2) within the housing, which may be biased upwardly by a spring 6, and a cam plate 7 on a cam shaft 8. The cam plate is rotatable, to force the follower piston downward. A compression pad 9 is adapted to apply piston forces to the sternum of the patient, and is located at the bottom of the follower piston, while a cam follower disk 10 may be interposed between the follower piston and the cam plate (at the top of the piston) to impinge upon the cam disk. The cam follower disk is rotatably fixed to the piston through cam follower shaft 11. (Note that the cam disk may act directly upon top of the compression pad if the compression pad is upwardly biased by another means, such as an elastic diaphragm, or is fixed to the cam plate with a box cam arrangement.) Thus, the basic system comprises a compression component adapted to contact the chest of the patient (the pad, for example), and a drive system operable to exert force on the compression component to impart repeated cycles of compression and release of compression on the chest of the patient. The drive system comprises a driving component, such as cam, shaped to control the compression waveform.

Manually powered means for converting substantially uniform manual effort into substantially irregular or non-uniform compression waveforms described below is benefit of the cam-operated system. As illustrated, the cam plate is fixed to hand crank handles 12, which may be turned by a CPR provider to rotate the cam plate. The spring acts to rapidly lift the follower piston and compression pad, so as to rapidly release compressive forces on the chest whenever the cam plate rotates to the notch. The desired up-stroke in the compression cycle is achieved with the energy stored in the spring during the downward stroke of the system. The device thus uses stored energy in the bias spring to control a portion of the compression cycle. Thus the CPR provider operates the device to store energy in the spring while imparting sufficient power to drive the compression pad downward. The CPR provider need only maintain consistent rotations of the cam, through the hand crank, and the cam shape will control the compression wave form independent of any other control from the CPR provider.

The gantry is fixed to a backboard 13 through support stanchions 14. As illustrated in FIGS. 2 and 3, the backboard is split into left and right portions, and the gantry is expandable transversely (across the width of the patient) through a ratcheting mechanism to allow transverse expansion to accommodate patients of varying size. Also, the stanchions are vertically expandable (expandable in the anterior/posterior dimension relative to the patient) with an expanding ratchet mechanism. The backboard is adapted to fit under the patient's thorax, and together with the stanchions and gantry provides a means for fixing the piston in relation to the patient, so that piston motion is converted to downward motion of the sternum and compression of the thorax. The gantry and stanchions maybe integrally formed as a single structure arching over the patient.

Figure 1:
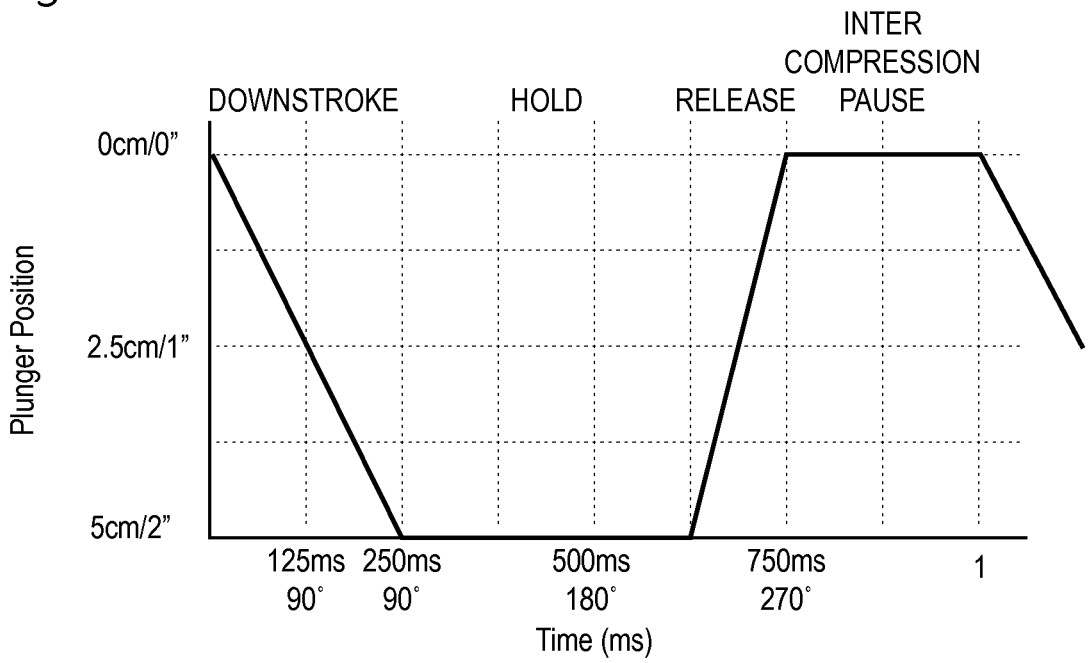
FIG. 1 illustrates a compression waveform useful for CPR.
Figure 4:
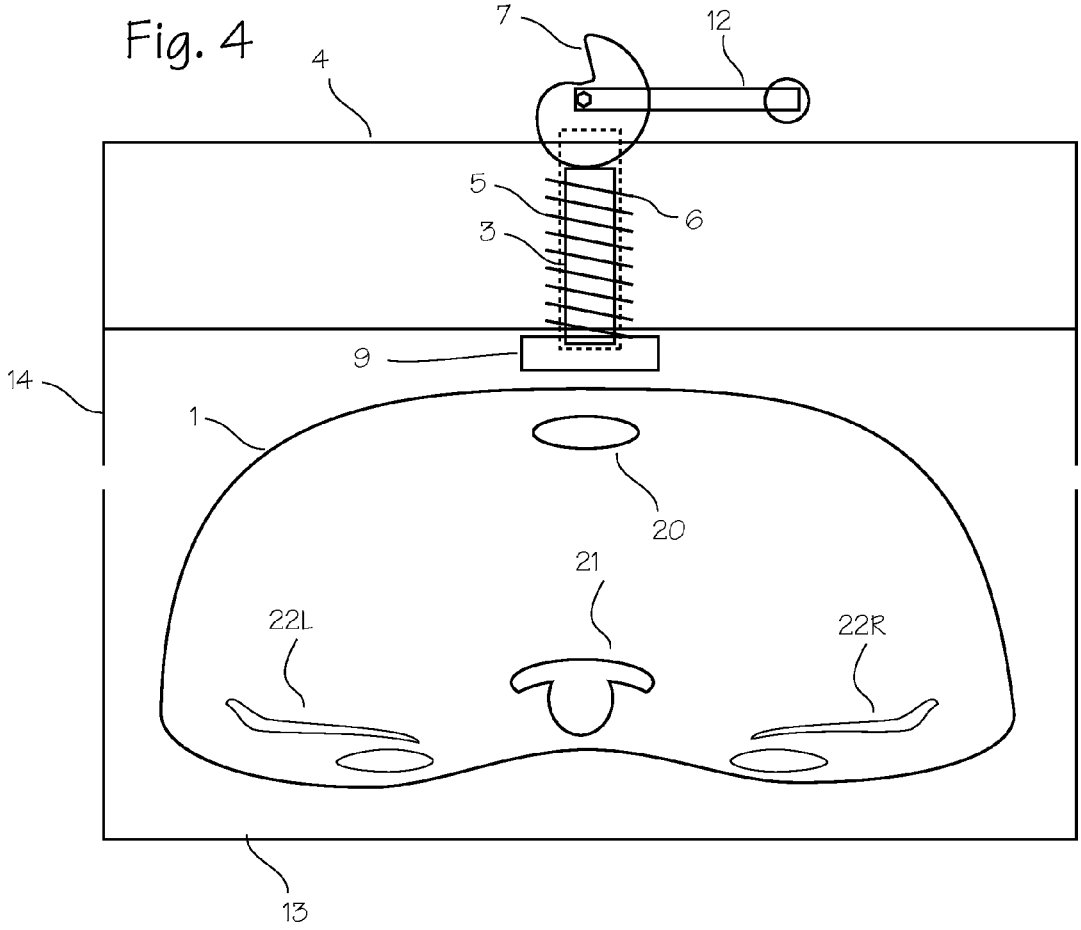
FIG. 4 is a cross section of the CPR compression device of FIG. 2.

FIG. 4 is a cross section of the device shown in FIG. 1, showing the gantry 4, piston housing 5, the piston 3, the bias spring 6, the cam plate 7, the compression pad 9 and the cam plate 7, with the underlying backboard 13 supporting the patient 1. The anatomical landmarks shown in this Figure include the sternum 20, the spine 21, and the right and left scapula 22R and 22L of the patient. The gantry, stanchions and backboard surround the patient such that the compression pad is located over the sternum, with the supporting stanchion descending from the gantry 4 to the backboard. In use, the patent must remain fixed relative to the piston housing and the backboard, with the sternum under the piston, and the spine and scapula over the backboard. The spine and scapula remain fixed, or nearly fixed, relative to the platform while the sternum and anterior portions of the thorax are compressed downwardly toward the spine, the scapula, and the backboard.

Figure 5:
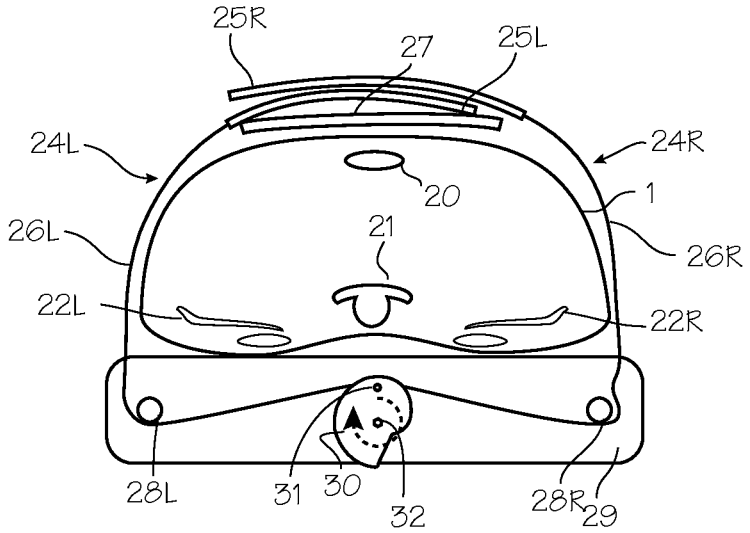
FIGS. 5 and 6 illustrates a CPR compression device with a cam operated compression belt.
Figure 6:
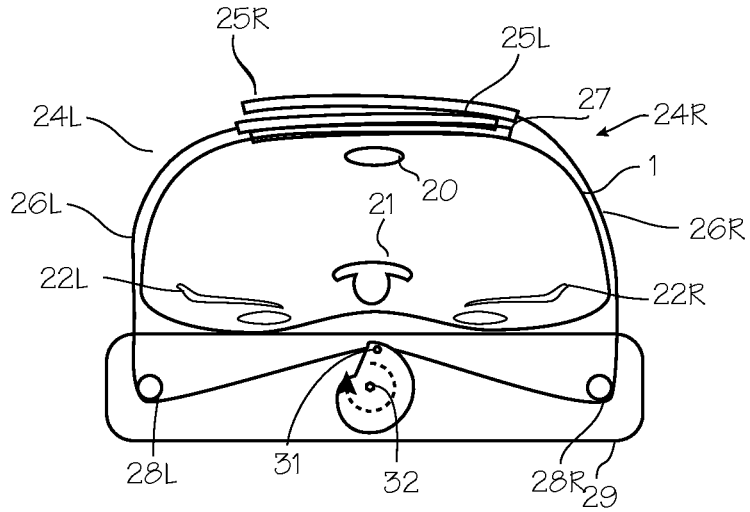

The cam-operated principle of FIGS. 2 and 3 can be implemented in devices similar to the ZOLL Circulation AUTOPULSE® compression device. FIG. 5 illustrates a CPR compression device with a cam-operated compression belt. The device includes a compression belt, installed on a patient 1. This device resembles the AUTOPULSE® CPR compression device, and its components include the compression belt 24L and 24R, the load distribution portions of the belt 25L and 25R, the narrow strap portions 26L and 26R, a bladder 27, the spindles 28L and 28R and a housing 29. The belt is driven tightened by a box cam 30, with a follower 31 following in a groove conforming to the outline of the cam, with the follower then impinging on the belt to push a portion of the belt downward, thereby tightening the belt about the chest and thorax of the patient and a resuscitative rate to accomplish CPR. The belt may ride over the follower, or it may be fixed to the follower The cam is mounted on the cam shaft 32 which may be driven by a motor disposed within the housing (the cam shaft may be the drive shaft of the motor, or may be indirectly connected to the motor through a gear box) or by a hand crank connected to the cam shaft by appropriate translating means. The anatomical landmarks shown in this Figure include the sternum 20, the spine 21, and the right and left scapula 22R and 22L of the patient. Referring to the landmarks, the chest compression band is wrapped around the patient such that the load distributing portions are located on the chest (that is, the anterior surface or portion of the thorax), over the sternum, with the narrow strap portions descending from the load distributing portions to wrap around the lateral spindles and thence run to the drive spool. The lateral spindles are spaced laterally from the medial centerline of the device so that they are disposed under, or lateral to, the scapulae of the typical patient, so that tightening of the compression band results in anterior/posterior compression of the chest. FIG. 6 illustrates the device of FIG. 5, in the high compression state. In FIG. 6 the cam has rotated 180°, forcing the belt upwardly within the housing, thus pulling the portion of the belt over the patient's chest downwardly to compress the chest.

Figure 7:
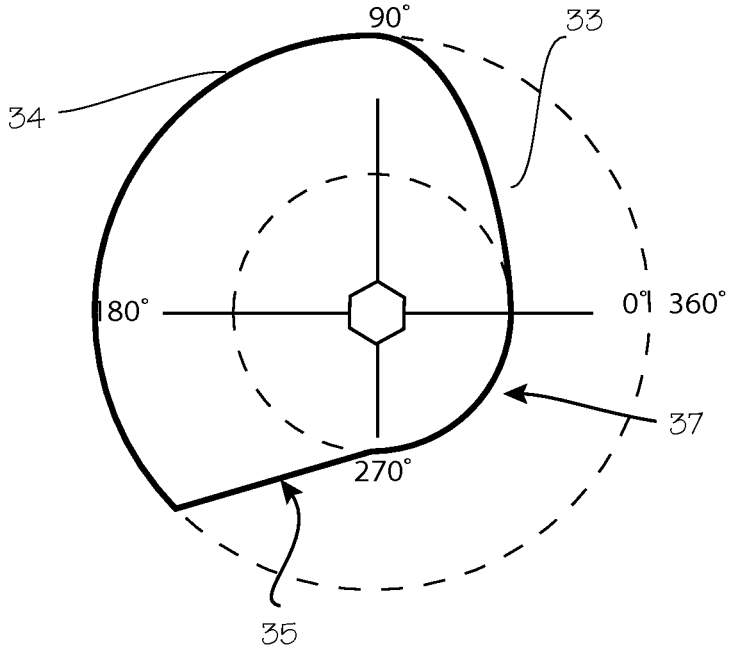
FIG. 7 illustrates a cam plate used in the devices of FIGS. 2 through 5.

FIG. 7 illustrates the cam plate used in the devices of FIGS. 2 through 5. The cam is shaped to provide at least three phases of compression during its rotation. First, the cam shape includes an angular rise ramp 33 wherein the radius of contact point of the cam with the idler wheel is increasing as the crank is rotated (increase-radius zone), which results in the downstroke phase (as illustrated in FIG. 1) of the compression waveform. This corresponds to the compression stroke which compresses the chest, and also corresponds to the downward stroke of the piston of FIG. 2. Next, in a following arc or angular range of the cam shape, the cam shape includes an isodiametric (relative to the cam shaft) top radius 34, where the radius of the contact point with the idler wheel is a substantially fixed radius as the crank is rotated (constant maximum radius zone). This corresponds to the hold phase (as illustrated in FIG. 1) of the compression waveform, and also corresponds to the period in which the piston of FIG. 2 is held at is maximum compressive position. Next, in a following arc or angular range of the cam shape, the cam shape includes a fall ramp 35, where the radius of the contact point with the idler wheel is decreasing as the crank is rotated (the fall ramp of the cam, or the decrease-radius zone). This correspond to the release phase (as illustrated in FIG. 1) of the compression waveform, and also corresponds to the period in which the piston of FIG. 2 rapidly rises to its uppermost position. There may also be a fourth phase in which the radius of the contact point of the cam with the idler wheel is a substantially constant radius. That is at a minimum (constant minimum zone), which results in the inter-compression pause phase. This portion of the cam is also isodiametric relative to the cam shaft. Each rotation of the cam causes a complete cycle of compression, high threshold hold, release and low threshold hold. The cam can be rotated at a rate of 90 to 120 compression per minute, to cause compressions at resuscitative rate of 90 to 120 compressions per minute. This rotational rate corresponds to compression rates recommended by the American Heart Association.

Figure 8:
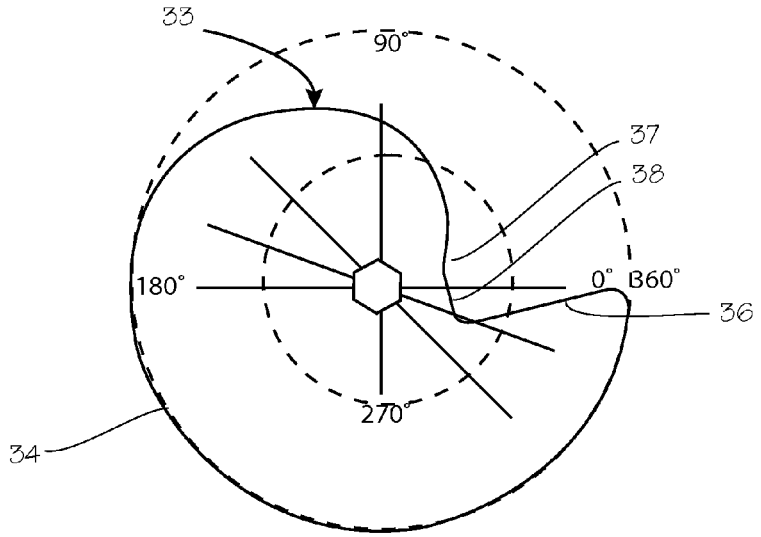
FIG. 8 illustrates a cam plate used in the devices of FIGS. 2 through 5.

FIG. 8 illustrates a cam configured to operated in conjunction with the piston to accomplished a similar waveform. A distinguishing feature of this cam is a notch fall ramp 36 immediately following a circular isodiametric top radius 34 of the cam which in turn follows the rise ramp 33 which follows an base radius 37 extending in turn to the notch through the notch-bottom radius transition 38. In this construction, the base radius immediately transitions into the rise ramp, and there is no bottom dwell arc of the cam to provide the relaxed state of the piston or belt. The rise ramp or opening ramp of the cam corresponds to the compression stroke of the piston or tightening of the belt, the top radius corresponds to the top dwell arc and the high threshold of compression, and the notch corresponds to the release stroke of the piston and relaxation of the belt.

As illustrated in the cams of FIGS. 7 and 8, and the associated cam diagrams, the increasing radius phase (the rise radius of the cam) is preferably of short duration, and the radial span of the increasing radius phase (the rise ramp) is on the order 45-160°, while the decreasing-radius phase (the fall ramp) is preferably of short duration relative to the remainder of the compression cycle, and the radial span of the decreasing-radius phase (the fall ramp) is on the order of 0-45 degrees of angular rotation of the cam. It is also preferable that the constant-radius phase (the top radius), corresponding to the hold-phase of the compression, be of longer duration, such as on the order of 90-180° degrees of rotation of the cam, or about 25% to 50% of the entire compression cycle. The inter-compression pause phase (the bottom radius of the cam), if provided by the cam shape, can be up to 90° of angular rotation of the cam, or about 25% of the entire compression cycle.

With a rotational rate of 100 rpm (600 ms/compression), the arcuate span of each portion of the cam can be arranged to provide a compression down-stroke phase of 200 milliseconds, a hold phase of 275 milliseconds, a release upstroke phase of 25 milliseconds and an inter-compression pause phase of 100 milliseconds.

Figure 9A:
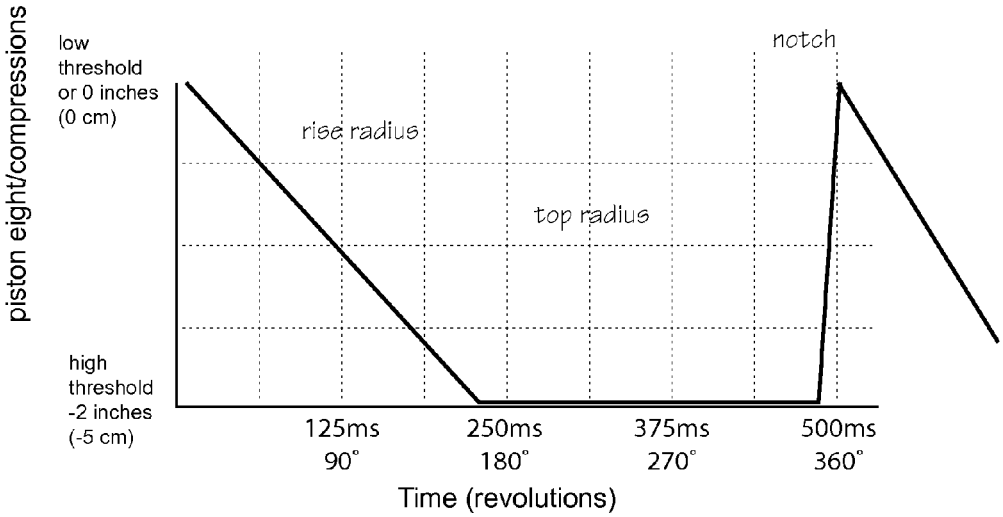
FIG. 9*a* is a graph of the compression waveform achieved by the cam operated piston or belt systems of FIGS. 1, 2 and 3.

The cam of FIG. 8 is shaped to provide a compression wave form including a compression phase characterized by a compression rise time, followed by a high threshold hold, followed by a release of compression which is substantially faster than the compression rise time. Specifically, when driven to accomplish 120 compressions per minutes, with a rise time of about 225 milliseconds, a high threshold hold time of about 250 milliseconds, rapid release time to a low threshold position with immediate return to the rise radius to start another compression without a pause before starting the next compression. The cam may also be described by the displacement diagram, which shows the relationship between the cam angle versus the follower displacement. FIG. 9*a* is a cam diagram of the piston height in relation to the cam plate position. In the diagram, the 0° position corresponds to the 0° position of the cam shown in FIG. 8 (this position is arbitrarily defined merely to establish correspondence between the cam shape and the cam diagram). As appears from the cam diagram, the shape of the cam in the rise radius portion provides for translation of piston/compression pad in the downward direction at a uniform compression rate to provide a compression to the patient at uniform rate, the shape of the cam in the top radius portion provides a static period of compression, in which the piston/compression pad is held at a substantially constant threshold of compression, and the shape of the cam plate in the fall ramp portion provides for translation of piston/compression pad in the upward direction at a rate substantially greater than the uniform compression rate, such that the compression pad is released from downward tension upon the chest of the patient. Additionally, the cam plate may have a fourth portion, shown in FIG. 7 (item 36), the shape of the cam plate holds the follower piston and compression pad substantially stationary to provide a static period of relaxation of the chest.

In FIG. 8, the decrease radius zone begins at 360° degrees, the increase radius zone begins at about 15° degrees, and the constant maximum radius zone begins at about 160° degrees. The constant maximum radius zone is substantially isodiametric relative to the cam shaft so that the piston position remains relatively fixed during this period. Due to the notched nature of the fall ramp and concomitant negligible angular span of the decrease radius zone, the piston will rise relatively quickly during this phase.

In FIG. 7, which depicts a cam which provides an inter-compression pause, the decrease radius zone begins at 225° degrees, the constant minimum radius zone begins at approximately 270°, the increase radius zone begins at 0°, and the constant maximum radius zone begins at 90°. The constant maximum radius zone is substantially isodiametric relative to the cam shaft so that the piston position remains relatively fixed during this period, as is also the case during the constant minimum radius zone. Due to the relatively short angular span of the decrease radius zone, the piston will rise relatively quickly during this phase.

Figure 9B:
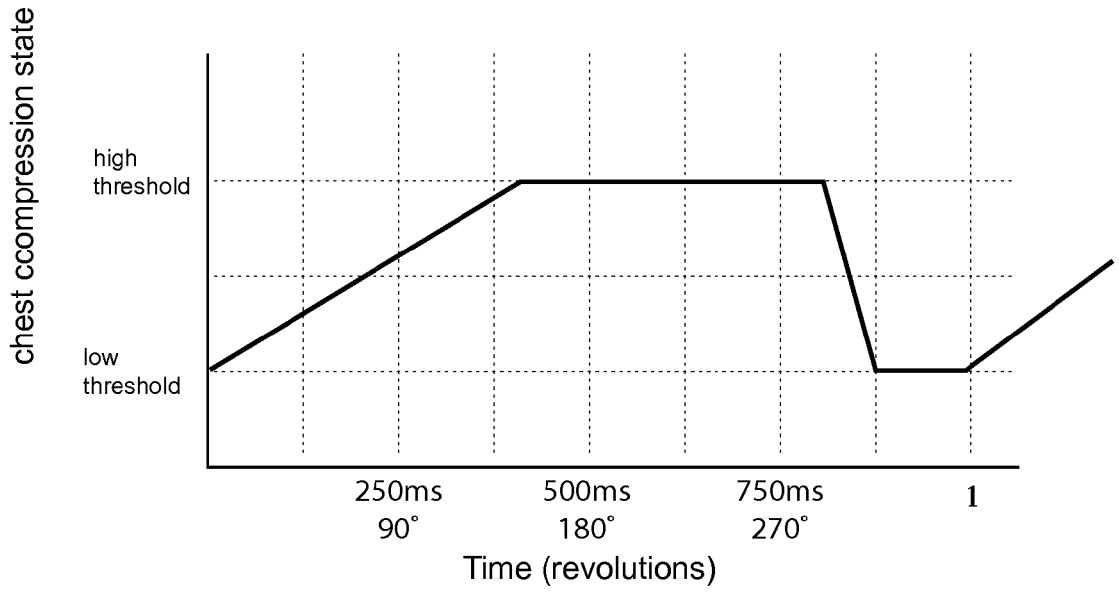
FIG. 9*b* is a graph of the compression waveform achieved by the cam operated piston or belt systems of FIGS. 2, 3 and 4.
Figure 10:
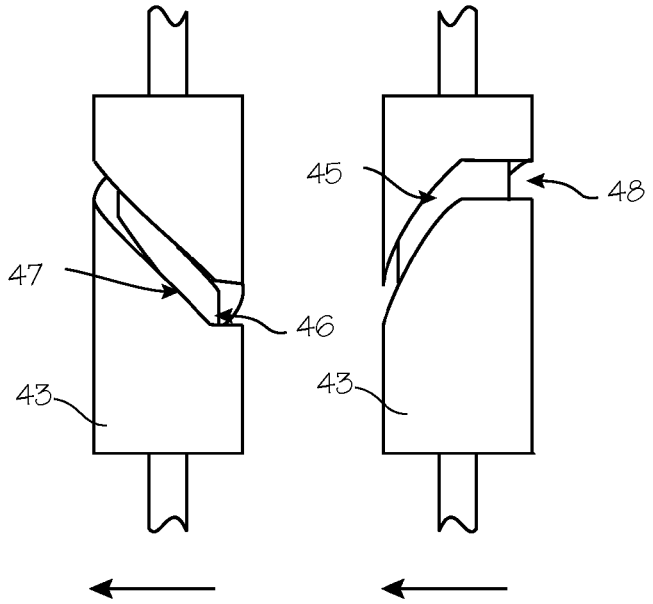
FIG. 10 illustrates a cylindrical cam suitable for use in the chest compression devices of the previous figures.

FIG. 9*b* is a graph of the compression waveform achieved by the cam operated piston or belt systems of FIGS. 2 through 5 when used with the cam of FIG. 8. This corresponds to a displacement diagram used to describe the effect of cam's on an associated cam follower. As shown in the diagram, the displacement of the follower (either the plate or the belt) depends on the angular position of the cam. Arbitrarily choosing the start of the compression cycle, in which the piston is moving downwardly or the cam of FIGS. 5 and 6 starts pushing upwardly on the belt, as the starting point for the diagram, which corresponds to 0° position of the cam shown in FIG. 7, the diagram shows increasing compression during the compression stroke, corresponding to the angular movement of the cam from 0° through 160°. This corresponds to the impingement of the compression ramp of the cam on the piston or the compression belt. Next, as the cam top radius impinges on the follower or the belt, at 160° through 360°, the follower/belt remains stationary and the compressive force on the chest remains at the high threshold shown in the graph as item 39. After the cam rotates and the top radius passes the follower or moves away from the belt, the notch passes the follower or opposes the belt, such that the compressive force on the belt drops off sharply. Finally, as the cam rotates back to 0°, the bottom radius impinges on the follower or belt Various cam arrangements can be used to achieve the compression waveform. A cylindrical cam operably connected to the follower which rides in a groove circumscribing the cylinder may be used in place of the cylinder plate. A suitable cylindrical cam is illustrated in FIG. 10, which shows a cylindrical cam 43 with a groove 44 circumscribing the cylinder. The groove accommodates a follower adapted to ride in the groove. The follower is also fixed to the piston shown in FIGS. 2 through 4, or the belt shown in FIGS. 5 and 6 through suitable translating mechanisms. On the cylindrical cam, the groove is characterized by arcuate regions 45, 46, 47 and 48 that correspond to the rise radius of the plate, the top radius of the plate, the fall ramp, and the bottom radius of the plate, respectively, when rotated clockwise from the top, as indicated by the arrows and engaged with a follower on top of the piston.

Figure 11:
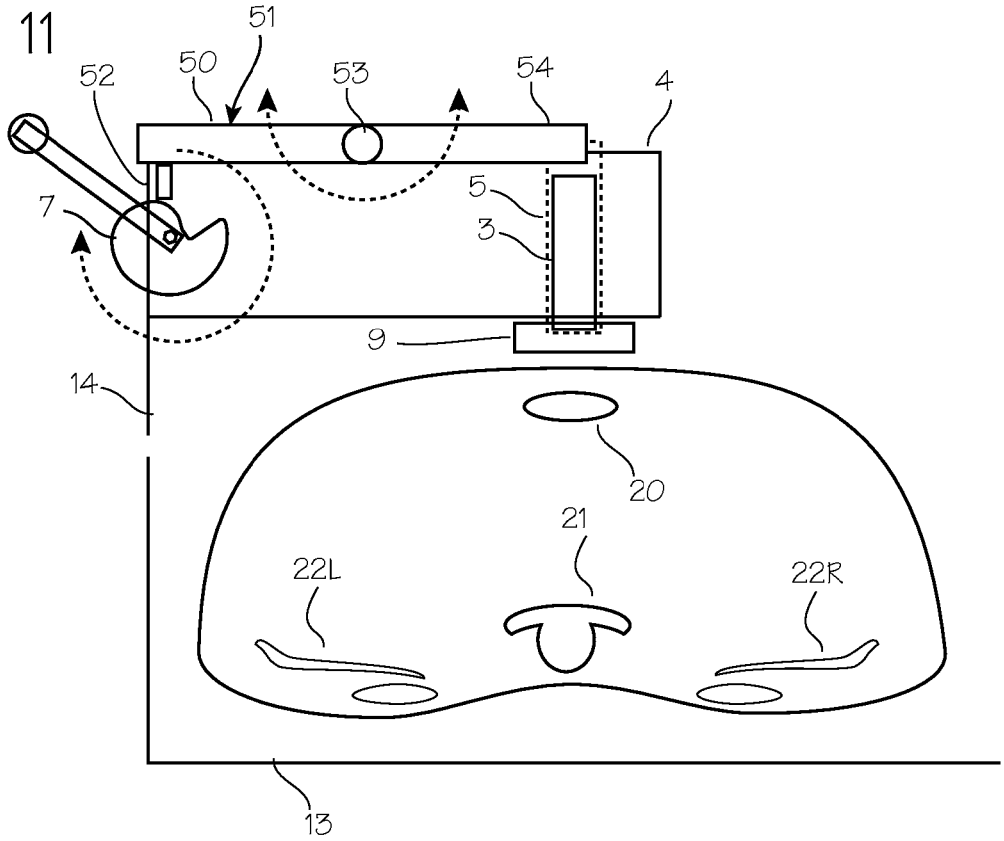
FIG. 11 illustrates a cam driven compression device with a cantilevered piston system.

FIG. 11 illustrates a cam driven compression device with a cantilevered piston system. In this system, the gantry 4 is supported only on one side of the patient (similar to the THUMPER® device). The piston 3 and compression pad 9 are arranged over the patients sternum, as in FIGS. 2 through 5, and the gantry is supported on stanchion 14 and thereby fixed to the backboard 13. The cam plate 7 is located to the side of the device, in a lateral portion of the gantry or in the stanchion, and impinges on rocker shaft portion 50 of the rocker 51. A follower shaft 52 or follower disk may be interposed between the cam plate and the rocker shaft. The rocker is mounted to the gantry through pivot 53, which permits rotation of the rocker such that upward motion of the rocker shaft portion results in downward motion of the rocker arm 54, piston 3 and compression pad 9.

Various means for translating cam motion to the compression piston or compression belt, in addition to the direct drive shown in FIGS. 4 and 5 and the lever shown in FIG. 11, may be used. The advantage of the various cam arrangements can be obtained with cams providing various compression waveforms, whether for clinical use or experimental use. The compression pad and the compression belt are suitable means for contacting the chest of the patient, but other chest contacting means may be used. As illustrated, a cam element, which can be a cam plate or a cam cylinder, may be shaped such that, when rotated to cyclically engage a chest compression means such as a chest compression piston, a chest compression belt, either directly or indirectly through translating means such as a follower or a rocker, the chest compression means is controlled to provide cyclic compression of the chest according to a compression wave form determined by the shape. The cam, in whatever form it takes, may be replaced readily with other cams shaped to provide different wave forms for clinical or experimental use. The cam plate may be enlarged (or a cam cylinder modified) to provide a deeper compression, and a larger difference between the deepest point of compression (the lowest position of the compression pad) and the highest point of release (the highest position of the compression pad). The contours of the cam plate, or grooves of a cam cylinder, can be modified easily to lengthen or shorten or change the radius of the top radius, rise ramp, the fall ramp, the base radius, and thus lengthen or shorten the high compression hold (defined by the operation of the top radius), lengthen or shorten the release of the compression (corresponding to the length or sharpness of the fall ramp), lengthen or shorten the low compression hold or complete relaxation (defined by the operation of the bottom radius), lengthen or shorten the compression stroke (defined by the shape of the rise ramp). Changes to any or all of the portions of the cam can be implemented merely by replacing the cam. The handcrank shown in the Figures provides a means for applying human power to the cam, and other means, such as foot pedals, may be used instead.

A rotational tachometer gauge may be provided within the vicinity of the crank axis, for use by the rescuer to maintain proper compression rate to the patient.

Thus, the devices and methods described above provide for simple mechanical control of a compression waveform. The desired waveform is one in which compression rise time is fairly rapid, compression is held substantially constant at a high threshold of compression, and release of compression is very rapid. In prior patents, such as U.S. Pat. No. 7,374,548, ZOLL Circulation has described a system for accomplishing suitable compression waveforms. This system is commercialized in the successful AUTOPULSE® CPR compression device, which compresses the chest of cardiac arrest patients with a compression belt driven by a motor with an associated control system. This system operates to provide a compression waveform with the desired fairly rapid, compression is held substantially constant as a high threshold of compression, and rapid release of compression. The desired waveform can be achieved in a manually operated CPR chest compression system, or a motorized system, by using the cam shaft with a cam engaging a follower to drive a compression component, which may be a compression pad adapted to impinge on the patient's chest or compression belt, in which case the follower plate of the piston, the piston, the compression pad or the surface of the belt acts as the follower. The cam in the system is a radial cam with a disk or cylinder which translates rotational motion of a hand crank or a motor drive shaft into linear displacement of a compression piston or linear pull on the compression belt. The compression component may also be a compression belt, in which case the follower acts on the compression belt or intermediate structures which translate the cam movement into belt tightening. The compression components described above are chest contacting means, and may be constructed in various configurations. The cam may be generally circular and eccentrically mounted on a drive shaft, or generally pear-shaped. As described above, other constructions, such as radial cam and angular roller follower, can also be used. These cams, and equivalent structures, comprise means for converting substantially uniform input (whether human powered or mechanically driven) into non-uniform motion of the means for compressing and resultant non-uniform compression waveforms applied to the patients chest.

While the preferred embodiments of the devices and methods have been described in reference to the environment in which they were developed, they are merely illustrative of the principles of the inventions. The elements of the various embodiments may be incorporated into each of the other species to obtain the benefits of those elements in combination with such other species, and the various beneficial features may be employed in embodiments alone or in combination with each other. Other embodiments and configurations may be devised without departing from the spirit of the inventions and the scope of the appended claims.

We claim:

1. A device for compressing the chest of a patient, where said patient is characterized by a chest and a sternum defining an area of said sternum, said device comprising:

a compression pad adapted to contact the chest of the patient in the area of the patient's sternum, and limited to the area of the patient's sternum;

a drive system operable to exert force on the compression pad to impart repeated cycles of compression and release of compression on the chest of the patient;

wherein the drive system comprises a cam system operable to force the compression pad downward, and the cam system comprises a radial cam, and the radial cam comprises a cam plate and a cam shaft, said cam shaft being operable to rotate the cam plate and said radial cam is operably connected to the compression pad through a follower; and wherein the cam plate is operable to rotate through a first portion of rotation, a second portion of rotation and a third portion of rotation, and said cam is shaped such that, for the first portion of rotation, the cam follower is translated in a first direction at a uniform compression rate to provide a compression to the patient at uniform rate, for the second portion of rotation comprising 90° to 180° of rotation of the cam plate, the cam follower is held substantially stationary to provide a static period of compression by a shape of the cam plate in the second portion comprising an isodiametric top radius where a radius of a contact point with the follower is a substantially fixed radius relative to the cam shaft, in which the compression component is held at a substantially constant threshold of compression, for the third portion of rotation, the follower is translated in a second direction at a rate substantially greater than the uniform compression rate, such that the compression pad is released from downward tension upon the chest of the patient.

2. A device for compressing the chest of a patient comprising:

chest compressing means for compressing the chest of the patient;

means for converting substantially uniform human-powered input powering the means for compressing into a non-uniform compression waveform;

means for applying human power to the means for converting;

wherein the means for converting comprises a cam, said cam having angular regions constituting an increase radius zone corresponding to a compression stroke of the chest compressing means, a constant maximum radius zone corresponding to a maximum compressive position of the chest contacting means, and a decrease radius zone corresponding to a release phase of the chest compressing means, wherein said constant maximum radius zone spans 90° to 180° of rotation of the cam.

3. The device of claim 2 wherein the cam has an additional angular region constituting a constant minimum zone with a constant minimum radius corresponding to a minimum compressive position of the chest compressing means.

4. A device for compressing the chest of a patient comprising:

means for contacting the chest of the patient;

a cam follower operably engaged with the contacting means;

a cam operably connected to a cam shaft and a means for rotating the cam shaft;

wherein the cam is shaped to provide a compression wave form including a compression phase characterized by a compression rise time, followed by a high threshold hold, followed by a release of compression which is substantially faster than the compression rise time; and wherein the cam comprises a cam plate and a cam shaft, said cam shaft being operable to rotate the cam plate through a first portion of rotation, a second portion of rotation and a third portion of rotation, and said cam is shaped such that, for the first portion of rotation, the cam follower is translated in a first direction at a uniform compression rate to provide a compression to the patient at a uniform rate, for the second portion of rotation comprising 90° to 180° of rotation of the cam plate, the cam follower is held substantially stationary to provide a static period of compression by a shape of the cam plate in the second portion comprising an isodiametric top radius where a radius of a contact point with the follower is a substantially fixed radius relative to the cam shaft, in which the contacting means is held at a substantially constant threshold of compression, for the third portion of rotation, the follower is translated in a second direction at a rate substantially greater than the uniform compression rate, such that the contacting means is released from downward tension upon the chest of the patient.

5. A device for compressing the chest of a patient comprising:

a backboard adapted for positioning under the thorax of the patient;

a gantry fixed to the backboard and disposed above the backboard, said gantry disposed relative to the backboard such that the gantry is disposed over the chest of the patient when the backboard is disposed under the thorax of the patient;

a compression pad adapted to contact the chest of the patient to transmit compressive forces to the chest;

a follower piston vertically fixed to the compression pad and disposed above the compression pad such that upward and downward motion of the piston results in upward and downward motion of the compression pad;

a cam plate operably engaged with the piston, and a cam shaft, said cam shaft being operable to rotate the cam plate;

a motor or hand crank operable to rotate the cam plate;

wherein the cam plate is operable to rotate through a first portion of rotation, a second portion of rotation and a third portion of rotation, and said cam is shaped such that, for the first portion of the rotation, the follower piston is translated downwardly at a uniform compression rate to force the compression pad downward to provide a compression to the patient at a uniform rate, for the second portion of angular rotation comprising 90° to 180° of rotation of the cam plate, the cam follower and compression pad are held substantially stationary to provide a static period of compression by a shape of the cam plate in the second portion comprising an isodiametric top radius where a radius of a contact point with the follower is a substantially fixed radius relative to the cam shaft, in which the compression pad is held at a substantially constant threshold of compression, for the third portion of rotation, the follower piston and compression pad are translated upwardly at a rate substantially greater than the uniform compression rate, such that the compression pad is released from downward tension upon the chest of the patient.

6. A device for compressing the chest of a patient comprising:

a backboard adapted for positioning under the thorax of patient;

a gantry fixed to the backboard and disposed above the backboard, said gantry disposed relative to the backboard such that the gantry is disposed over the chest of the patient when the backboard is disposed under the thorax of the patient;

a compression pad adapted to contact the chest of the patient to transmit compressive forces to the chest;

a follower piston vertically fixed to the compression pad and disposed above the compression pad such that upward and downward motion of the piston results in upward and downward motion of the compression pad, a cam plate operably engaged with the piston, and a cam shaft, said cam shaft being operable to rotate the cam plate;

a motor or hand crank operable to rotate the cam plate;

wherein the cam plate is operable to rotate through a first portion of rotation, a second portion of rotation, a third portion of rotation, and a fourth portion of rotation, and said cam is shaped such that, the first portion of angular rotation, the follower piston is translated downwardly at a uniform compression rate to force the compression pad downward to provide a compression to the patient at a uniform rate, for the second portion of rotation comprising 90° to 180° of rotation of the cam plate, the cam follower and compression pad are held substantially stationary to provide a static period of compression by a shape of the cam plate in the second portion comprising an isodiametric top radius where a radius of a contact point with the follower is a substantially fixed radius relative to the cam shaft, in which the compression pad is held at a substantially constant threshold of compression, for the third portion of rotation, the follower piston and compression pad are translated upwardly at a rate substantially greater than the uniform compression rate, such that the compression pad is released from downward tension upon the chest of the patient, and for the fourth portion rotation, the follower piston and compression pad are held substantially stationary to provide a static period of relaxation of the chest.

7. A device for compressing the chest of a patient comprising:

a backboard adapted for positioning under the thorax of patient;

a gantry fixed to the backboard and disposed above the backboard, said gantry disposed relative to the backboard such that the gantry is disposed over the chest of the patient when the backboard is disposed under the thorax of the patient;

a compression pad adapted to contact the chest of the patient to transmit compressive forces to the chest;

a follower piston vertically fixed to the compression pad and disposed above the compression pad such that upward and downward motion of the piston results in upward and downward motion of the compression pad, a cam plate operably engaged with the piston, and a cam shaft, said cam shaft being operable to rotate the cam plate;

a motor or hand crank operable to rotate the cam plate;

wherein the cam plate is operable to rotate through a first portion of rotation, a second portion of rotation, a third portion of rotation, and a fourth portion of rotation, and said cam is shaped such that, for the first portion of rotation, the follower piston is translated downwardly at a uniform compression rate to force the compression pad downward to provide a compression to the patient at a uniform rate, for the second portion of rotation comprising 90° to 180° of rotation of the cam plate, the cam follower and compression pad are held substantially stationary to provide a static period of compression by a shape of the cam plate in the second portion comprising an isodiametric top radius where a radius of a contact point with the follower is a substantially fixed radius relative to the cam shaft, in which the compression pad is held at a substantially constant threshold of compression, for the third portion of rotation, the follower piston and compression pad are translated upwardly at a rate substantially greater than the uniform compression rate, such that the compression pad is released from downward tension upon the chest of the patient, and for the fourth portion of rotation, the follower piston and compression pad are held substantially stationary to provide a static period of compression at a low threshold.

* * * * *